US006775386B1

(12) United States Patent
Chou

(10) Patent No.: US 6,775,386 B1
(45) Date of Patent: Aug. 10, 2004

(54) MICROPHONE ATTACHED REMOTE CONTROLLER

(75) Inventor: Chin-Wen Chou, Taipei (TW)

(73) Assignee: Shin Jiuh Corp., Hsin-Tien (TW)

( * ) Notice: Subject to any disclaimer, the term of this patent is extended or adjusted under 35 U.S.C. 154(b) by 563 days.

(21) Appl. No.: 09/680,253

(22) Filed: Oct. 5, 2000

(51) Int. Cl.[7] ..... H04R 3/00

(52) U.S. Cl. ..... 381/110; 380/111; 340/825.69; 348/734

(58) Field of Search ..... 381/110, 111, 381/120, 122; 340/825.69, 825.72; 348/734

(56) References Cited

U.S. PATENT DOCUMENTS 6,094,156 A * 7/2000 Henty ..... 340/825.69

FOREIGN PATENT DOCUMENTS

JP 08-062724 * 3/1996 ..... G03B/21/54

* cited by examiner

*Primary Examiner*—Melur Ramakrishnaiah
(74) *Attorney, Agent, or Firm*—Birch, Stewart, Kolasch & Birch, LLP

(57) ABSTRACT

A microphone attached remote controller mainly comprises a coupling unit, a switch unit, a first control unit, a sensor, a second control unit, an amplifier, and a wireless emitter. When the switch unit is triggered, the first control unit will forward a signal to disable the second control unit and enter a remote control mode, or the first control unit is supposed to have its scanning function temporarily paused and enter a microphone mode for input, amplification, and reproduction of audio signals.

6 Claims, 2 Drawing Sheets

MICROPHONE ATTACHED REMOTE CONTROLLER

BACKGROUND OF THE INVENTION

This invention relates generally to remote controllers, more particularly to a microphone attached remote controller.

"Bring a cinema home!" has finally come true since late 20th century that enables people to enjoy movies at home instead of going to a cinema outside.

In playing an audio/video equipment, such as a vocal accompaniment, a video recorder, or a videodisc player, a user is supposed to depress keys on a wireless emitter for remote control of power on/off, channel or song selection, etc, and on-spot singing can be reproduced through a generic microphone. However, as the microphone and the wireless emitter are individual bodies, the user is probably busy in switching between those two bodies occasionally on his way of singing and operation that may cause inconvenience.

In viewing so, some makers have tried disposing a control key on the microphone later on for tuning which is unfortunately helpless for eliminating abovesaid inconvenience.

SUMMARY OF THE INVENTION

The primary object of this invention is to eliminate abovesaid defects by combining a microphone with a remote controller to become an easy-use unitary device.

Another object of this invention is to provide a portable microphone attached dual-purpose remote controller without occupying too much space.

For realizing above objects, the microphone attached remote controller comprises a coupling unit, a switch unit, a first control unit, a sensor, a second control unit, an amplifier, and a wireless emitter. When the switch unit is triggered, the first control unit will forward a signal to disable the second control unit and enter a remote control mode, or the first control unit is supposed to have its scanning function temporarily paused and enter a microphone mode for input, amplification, and reproduction of audio signals.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
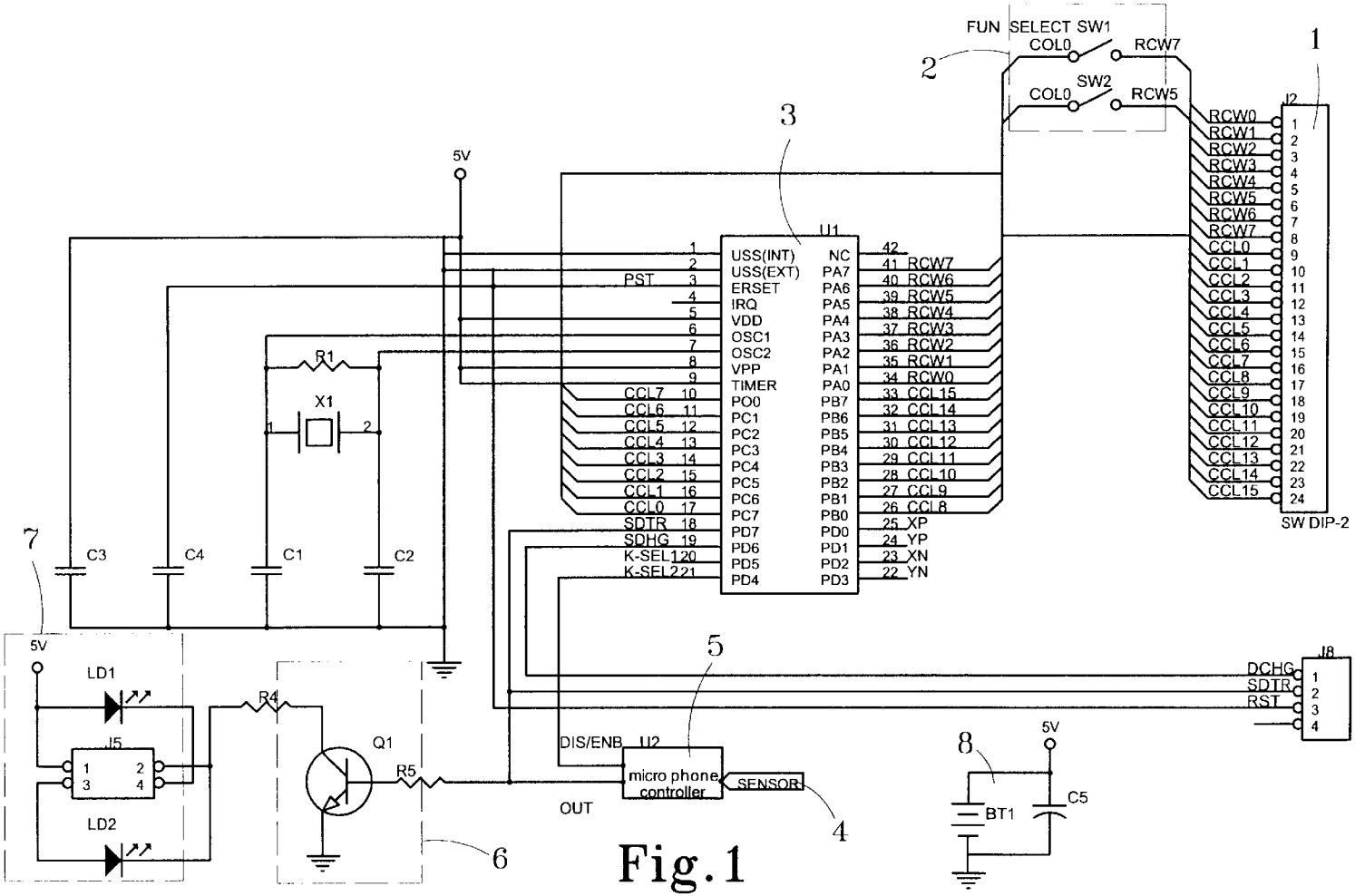
FIG. 1 is a circuit diagram of this invention.

According to a circuit diagram shown in FIG. 1, a microphone attached remote controller is basically an integrated unit including an audio signal input microphone and a wireless remote controller for distant control of the electric home appliance.

The microphone attached remote controller of this invention mainly comprises a coupling unit 1, a switch unit 2, a first control unit 3, a sensor 4, a second control unit 5, an amplifier 6, and a wireless emitter 7.

The coupling unit 1 is used for connecting with a variety of different push-button groups (not shown) and for input of commands.

The switch unit 2 could be, but not necessarily be, a push-button switch, a toggle or a tact switch, or an electronic switch connected to the coupling unit 1 and is activated to validate remote control function.

When the switch unit 2 is activated, an output signal is applied to the first control unit 3, which in turn forwards an output signal to disable the second control unit 5. At this moment, the first control unit 3 will keep scanning the push-button groups for remote control of the electric home appliance, such as a vocal accompaniment, a video recorder, a videodisc player, etc.

The sensor 4 is used for sensing any input audio signal.

The second control unit 5 is arranged to receive signals from the first control unit 3 and the sensor 4, and is in charge of processing the audio signals of the latter. The amplifier 6 is provided basically for power amplification and is connected together with the output terminal of the first and the second control unit 3, 5 in order to amplify the instruction signals of the first control unit 3 or the audio signals processed by the second control unit 5.

The wireless emitter 7 is used to emit amplified signals of the amplifier 6 in form of infrared-ray or radio waves for control of the electric home appliance or reproduction of the audio signals of the microphone.

Figure 2:
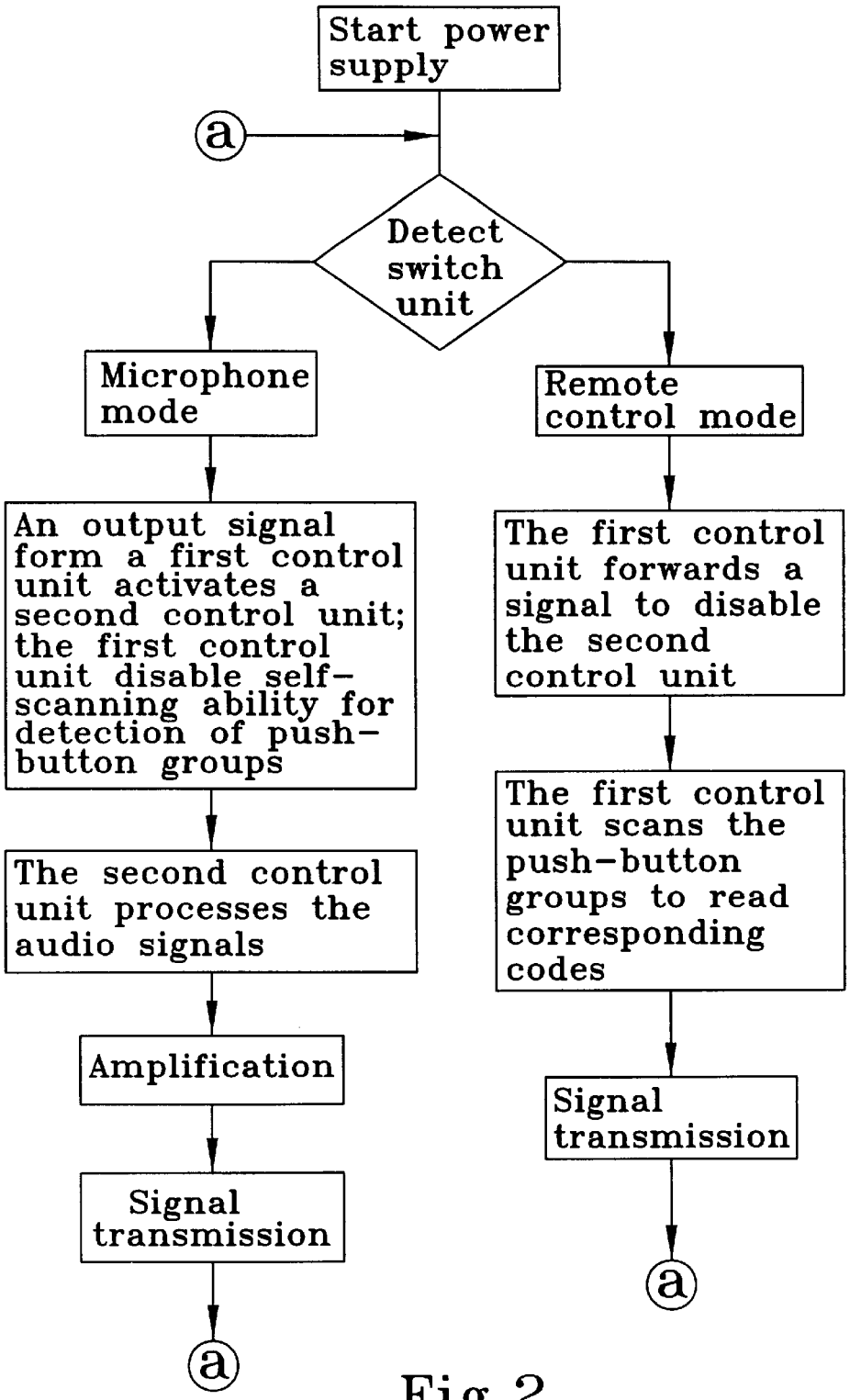
FIG. 2 is a control flowchart of this invention.

As illustrated in FIG. 2, after a power supply 8 is effected, the operation flowchart of this invention enters a detection mode at the very first moment to check whether the switch unit 2 is triggered or not; if positive, the flowchart enters a remote control mode, then the first control unit 3 is supposed to provide an output signal to disable the second control unit 5 and scan to read corresponding codes of the push-button groups of the coupling unit 1. The codes are now processed in the amplifier 6 and transmitted from the wireless emitter 7 for controlling the electric home appliance.

On the contrary, if the switch unit 2 is not triggered, the flowchart enters a microphone mode. At this moment, the first control unit 3 applies an output signal on the second control unit 5 to activate the latter, and meanwhile, disable self-scanning ability for detection of the push-button groups. The audio signals sensed by the sensor 4 are forwarded to the second control unit 5 for procession, then to the amplifier 6 for amplification, and finally to the wireless emitter 7 for emission of audio signals to the electric home appliance and for reproduction.

Hence, in short, the microphone attached remote controller of this invention is applicable either for input, amplification, and reproduction of audio signals or for remote control of the electric home appliance alternatively.

In the above described, at least one preferred embodiment has been elucidated with reference to drawings annexed, it is apparent that numerous variations or modifications may be made without departing from the true spirit and scope thereof, as set forth in the claims below.

What is claimed is:

1. An audio control system, comprising:

a microphone for generating input audio signals;

a remote controller for wireless-control operation of an electric appliance, including:

a switch unit for selecting control functions;

a second control unit for processing said input audio signals;

a first control unit coupled with the switch unit and the second control unit respectively, wherein the first control unit forwards an output signal to the second control unit and disables the latter when the switch unit is triggered; otherwise, the second control unit is activated and the first control unit pauses its self-scanning function;

an amplifier coupled with the first and the second control unit respectively so as to amplify output signals of those control units; and a wireless emitter coupled to an output terminal of the amplifier for transmitting amplified signals to the electric appliance for reproduction of audio signals and/or function control of the latter.

2. The system according to claim 1, wherein the switch unit is a push-button switch, a toggle or tact switch, or an electronic switch.

3. The system according to claim 1, wherein a coupling unit is further provided for connecting with a plurality of push-button groups.

4. The system according to claim 1, wherein a sensor is further provided for sensing audio signals.

5. The system according to claim 1, wherein a power supply is further included.

6. The system according to claim 1, wherein the wireless emitter transmits infrared ray or radio waves.

* * * * *